US008791366B2

(12) United States Patent
Nonen et al.

(10) Patent No.: US 8,791,366 B2
(45) Date of Patent: Jul. 29, 2014

(54) NON-DRAIN DIFFERENTIAL SIGNAL TRANSMISSION CABLE AND GROUND CONNECTION STRUCTURE THEREOF

(75) Inventors: Hideki Nonen, Hitachi (JP); Takahiro Sugiyama, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 1 day.

(21) Appl. No.: 13/615,459

(22) Filed: Sep. 13, 2012

(65) Prior Publication Data

US 2013/0072041 A1 Mar. 21, 2013

(30) Foreign Application Priority Data

Sep. 16, 2011 (JP) ..... 2011-203521
Aug. 6, 2012 (JP) ..... 2012-174052

(51) Int. Cl.
*H01B 11/04* (2006.01)
*H01B 11/06* (2006.01)
*H01B 7/295* (2006.01)

(52) U.S. Cl.
USPC ..... 174/113 R

(58) Field of Classification Search
CPC ..... H01B 11/04; H01B 11/06; H01B 7/295; H01B 11/02; H01B 9/003
USPC ..... 174/113 R
See application file for complete search history.

(56) References Cited

U.S. PATENT DOCUMENTS 6,380,485 B1 * 4/2002 Beaman et al. ..... 174/88 R
6,910,897 B2 * 6/2005 Driscoll et al. ..... 439/65
2008/0314613 A1 * 12/2008 Huang et al. ..... 174/107
2011/0100682 A1 * 5/2011 Nonen et al. ..... 174/254

FOREIGN PATENT DOCUMENTS

JP 2011-090959 A 5/2011

* cited by examiner

*Primary Examiner* — Jenny L Wagner
*Assistant Examiner* — Michael P McFadden
(74) *Attorney, Agent, or Firm* — McGinn IP Law Group, PLLC

(57) ABSTRACT

A non-drain differential signal transmission cable includes a pair of signal conductors aligned in parallel, an insulation around the pair of signal conductors, a shield conductor around the insulation, and a ground connecting pin to electrically connect the shield conductor to a ground, the ground connecting pin including a wire. An end portion of the pair of signal conductors is exposed with the insulation and the shield conductor removed. The ground connecting pin includes a winding portion wound around the shield conductor to be electrically connected to the shield conductor, and a pin portion extending from the winding portion and having an elongate shape.

20 Claims, 7 Drawing Sheets

NON-DRAIN DIFFERENTIAL SIGNAL TRANSMISSION CABLE AND GROUND CONNECTION STRUCTURE THEREOF

The present application is based on Japanese patent application Nos. 2011-203521 and 2012-174052 filed on Sep. 16, 2011 and Aug. 6, 2012, respectively, the entire contents of which are incorporated herein by reference,

BACKGROUND OF THE INVENTION

1. Field of the Invention

The invention relates to a non-drain differential signal transmission cable and a ground connection structure thereof.

2. Description of the Related Art

In devices to handle high-speed digital signals of several Gbit/s or more, such as a server, a router or a storage device, differential signal transmission is used for signal transmission between devices or substrates (circuit boards) in a device.

The differential signal transmission is conducted such that signals with 180° inverted phases are transmitted through two paired signal conductors and a difference between the signals received on the side of a receiver is synthesized and outputted. Since currents flowing in the pair of signal conductors flow in opposite directions to each other, electromagnetic wave radiated from a transmission line is small. In addition, since noise from outside is equally superposed on the pair of signal conductors, the effect of noise can be cancelled by synthesizing and outputting the difference on the side of the receiver. Due to these reasons, the differential signal transmission is often used for the high-speed digital signal transmission.

As shown in FIG. 16 and FIG. 17 which is a cross sectional view taken on line B-B of FIG. 16, a differential signal transmission cable 160 used for the differential signal transmission has a pair of signal conductors 161, an insulation 162 covering together the pair of signal conductors 161, a shield conductor 163 provided on an outer periphery of the insulation 162 and a sheath 164 provided on an outer periphery of the shield conductor 163.

The shield conductor 163 may be formed by winding a tape with a conductor (a shielding tape) or is formed by covering with a braided strand. In addition, the sheath 164 may be formed by winding an insulating tape or is formed by extrusion coating of resin.

The differential signal transmission cable 160 is a twinax cable which has a pair of signal conductors 161 aligned in parallel and in which a difference in physical length between the pair of signal conductors 161 and attenuation of signal at high frequency are less than a twisted pair cable formed by twisting a pair of signal conductors. In addition, since the shield conductor 163 is provided covering the pair of signal conductors 161, the characteristic impedance is not unstable even if a metal is placed near the cable, and the noise immunity is also high. Due to such advantages, twinax cables are often used for short-distance signal transmission at relatively high speed.

By the way, the differential signal transmission cable 160 does not have a drain wire. Therefore, for connecting the differential signal transmission cable 160 to a substrate 165, after peeling the differential signal transmission cable 160 in a tiered manner, each of the paired signal conductors 161 is connected to a signal line pad 166 on the substrate 165 using a solder 167 while the shield conductor 163 is directly connected, using the solder 167, to a ground pad 170 which is connected to an inner ground layer 168 in the substrate 165 via a through-hole 169.

The related art may include JP-A-2011-90959.

SUMMARY OF THE INVENTION

As described above, since the shield conductor 163 is directly soldered to the ground pad 170, heat can be necessarily conducted from the tip of a soldering iron to the shield conductor 163 and the insulation 162 during the soldering work.

Therefore, if the shield conductor 163 is melted or evaporated and the insulation 162 is deformed or melted by the heat applied during the soldering work (e.g., about 230 to 280° C.), the impedance mismatch may occur at a connecting portion between the differential signal transmission cable 160 and the substrate 165 (a cable connecting portion) to impair the electrical characteristics of the differential signal transmission cable 160.

In addition, since a solder fillet needs to be formed in a solder layer in order to ensure an appropriate (highly reliable) solder-connected state of the shield conductor 163, the ground pad 170 needs to have such a large width (or area) that the solder fillet can be formed therein.

Therefore, when the plural differential signal transmission cables 160 are mounted, the package density is limited since the arrangement interval between the plural differential signal transmission cables 160 depends on the width of the ground pad 170.

Accordingly, it is an object of the invention to provide a non-drain differential signal transmission cable that can prevent the thermal load applied to the shield conductor/insulation during the soldering work and improve the package density, and a ground connection structure thereof.

(1) According to one embodiment of the invention, a non-drain differential signal transmission cable comprises:

a pair of signal conductors aligned in parallel;

an insulation around the pair of signal conductors;

a shield conductor around the insulation; and a ground connecting pin to electrically connect the shield conductor to a ground, the ground connecting pin comprising a wire, wherein an end portion of the pair of signal conductors is exposed with the insulation and the shield conductor removed, and wherein the ground connecting pin comprises a winding portion wound around the shield conductor to be electrically connected to the shield conductor, and a pin portion extending from the winding portion and having an elongate shape.

In the above embodiment (1) of the invention, the following modifications and changes can be made.

(i) The pin portion is formed by twisting together both end portions of the wire.

(ii) The ground connecting pin comprises a pin member comprising a spiral portion formed by shaping a portion of the wire into a spiral shape and the pin portion formed by shaping the end portion of the wire into a pin shape, the pin member being preliminarily made, and wherein the spiral portion of the pin member is attached as the winding portion around the shield conductor to form the ground connecting pin.

(iii) The winding portion is formed by winding a portion of the wire twice or more around the shield conductor.

(iv) The winding portion is solder-connected to the shield conductor.

(v) The wire comprises a copper wire and silver- or tin-plating applied to the copper wire.

(vi) The pin portion is disposed parallel to the pair of signal conductors.

(vii) The pin portion is disposed so as to cross a center line that passes through a center of the pair of signal conductors.

(viii) Two of the pin portion are provided.

(ix) The two pin portions are provided line-symmetrically with respect to a line orthogonally passing the center of a line segment connecting the centers of the pair of signal conductors.

(2) According to one embodiment of the invention, a ground connection structure of a non-drain differential signal transmission cable comprises:

the non-drain differential signal transmission cable according to the above embodiment (1); and a substrate on which a signal line pad for connecting the pair of signal conductors and a ground pad for connecting the shield conductor are formed;

wherein the pair of exposed signal conductors is solder-connected to the signal line pad and the shield conductor is electrically connected to the ground pad via the pin portion.

In the above embodiment (2) of the invention, the following modifications and changes can be made.

(x) The signal line pad is formed at an edge of the substrate so as to be orthogonal to one side of the edge at an interval equal to that of the signal conductors.

(xi) The ground pad is formed parallel to the signal line pad.

(xii) The signal line pad and the ground pad are formed at a distance from the edge of the substrate.

(xiii) The non-drain differential signal transmission cable is arranged at the edge of the substrate so that only the pair of signal conductors and the pin portion are located on the substrate.

(xiv) The signal line pad and the ground pad are formed on both sides of the substrate, and the non-drain differential signal transmission cables are attached to the both sides of the substrate.

(xv) The ground pad is formed symmetrically on both sides of the signal line pads.

Effects of the Invention

According to one embodiment of the invention, provided are a non-drain differential signal transmission cable that can prevent the thermal load applied to the shield conductor/insulation during the soldering work and improve the package density, and a ground connection structure thereof.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Preferred embodiments of the invention will be described below in conjunction with the appended drawings.

Firstly, a non-drain differential signal transmission cable in a first embodiment will be described.

Figure 1:
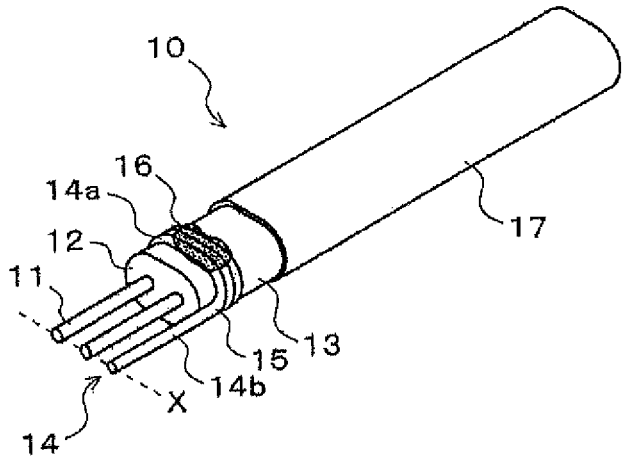
FIG. 1 is a perspective view showing a non-drain differential signal transmission cable in a first embodiment of the present invention.

As shown in FIG. 1, a non-drain differential signal transmission cable 10 in the first embodiment is provided with a pair of signal conductors 11 arranged side by side, an insulation 12 provided around the pair of signal conductors 11, a shield conductor 13 provided around the insulation 12 and a ground connecting pin 14 formed of a wire 15 for solder connection of the shield conductor 13 to a ground (which is, e.g., a below-described ground pad or may be a terminal, etc.), wherein end portions of the pair of signal conductors 11 are exposed from the insulation 12 and the shield conductor 13, and the ground connecting pin 14 is provided with a winding portion 14*a* as a portion of the wire 15 wound around the shield conductor 13 and a pin portion 14*b* as a pin-shaped end portion of the wire 15.

The non-drain differential signal transmission cable means a differential signal transmission cable which does not have a drain wire.

For making the ground connecting pin 14, the wire 15 is wound around the shield conductor 13 and an end portion of the wound wire 15 is formed into a pin shape.

For forming the winding portion 14*a*, a portion of the wire 15 is wound twice or more around the shield conductor 13. This allows the winding portion 14*a* to be tightly in contact throughout the entire circumference of the shield conductor 13, and accordingly, effect on electric field distribution in the vicinity of the wound portion of the wire 15 caused by a gap generated between the shield conductor 13 and the winding portion 14*a* is eliminated and impedance mismatch caused thereby can be eliminated.

The winding portion 14*a* is soldered to the shield conductor 13. As a result, it is possible to reliably ensure a contact state between the shield conductor 13 and the winding portion 14*a*.

Since the shield conductor 13 is connected to a ground via the pin portion 14*b*, heat is applied to the shield conductor 13 only at the time of soldering the winding portion 14*a* to the shield conductor 13. In addition, an amount of solder used for soldering the winding portion 14*a* to the shield conductor 13 is smaller than an amount of solder used for soldering the shield conductor 13 directly to the ground. This is because the latter requires only a small area for solder connection. Therefore, an amount of heat applied at the time of soldering the winding portion 14*a* to the shield conductor 13 is smaller than an amount of heat applied when soldering the shield conductor 13 directly to the ground, and does not cause melting or evaporation of the shield conductor 13 and deformation or melting of the insulation 12.

The wire 15 is composed of a copper wire and silver- or tin-plating applied to the copper wire. The copper wire is excellent in conductivity and is also cheap, hence, it is possible to reduce the price of the non-drain differential signal transmission cable 10. In addition, it is possible to improve solder wettability by applying silver- or tin-plating, which allows a good connecting condition to be ensured when the winding portion 14*a* formed of a portion of the wire 15 is soldered to the shield conductor 13 and when the pin portion 14*b* formed of a portion of the wire 15 is soldered to a ground.

The pin portion 14*b* is provided in parallel to the pair of signal conductors 11. Accordingly, a distance between the pair of signal conductors 11 and the pin portion 14*b* can be kept constant, and thus, impedance mismatch caused by variation in the distance between the pair of signal conductors 11 and the pin portion 14*b* can be reduced.

The pin portion 14*b* is provided so as to cross a center line X which passes through the centers of the paired signal conductors 11. Therefore, it is not necessary to bend the pair of signal conductors 11 or the pin portion 14*b* at the time of connecting the non-drain differential signal transmission cable 10 to the substrate (the detail will be described later) and it is possible to respectively solder the pair of signal conductors 11 and the pin portion 14*b* to the ground in a state of being arranged in parallel to each other and in a state that a distance therebetween is kept constant, hence impedance mismatch is less likely to occur.

Figure 2:
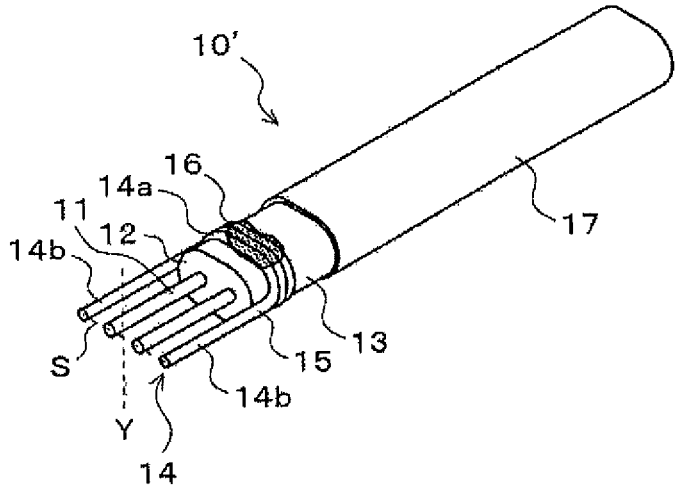
FIG. 2 is a perspective view showing a non-drain differential signal transmission cable in a modification of the first embodiment of the invention.

Two pin portions 14*b* may be provided as is in a non-drain differential signal transmission cable 10' shown in FIG. 2. In this case, the pin portions 14*b* are provided line-symmetrically with respect to a line Y which is orthogonal passing the center of a line segment S connecting the centers of the paired signal conductors 11. Accordingly, electric field distribution for the pair of signal conductors 11 can be balanced, and impedance mismatch caused by an asymmetry property of the electric field distribution can be reduced.

Figure 3:
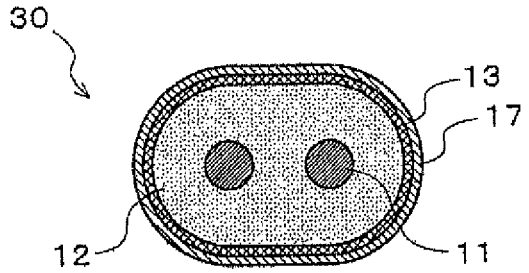
FIG. 3 is a cross sectional view showing an example of a cable structure to which the invention is applicable.

Cable structures to which the invention is applicable include a cable structure 30 having a pair of signal conductors 11, the insulation 12 covering around the pair of signal conductors 11 all together, the shield conductor 13 provided on an outer periphery of the insulation 12 and a sheath 17 provided on an outer periphery of the shield conductor 13, as shown in FIG. 3. The cable structure 30 is used in the non-drain differential signal transmission cables 10 and 10' shown in FIGS. 1 and 2.

Figure 4:
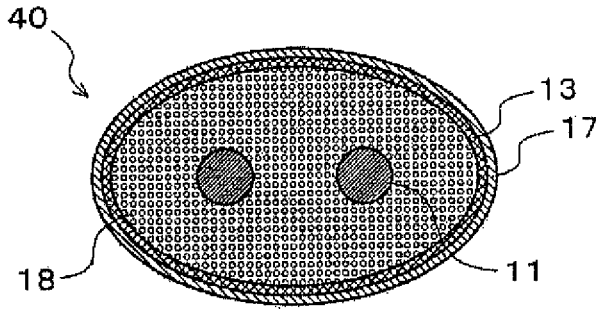
FIG. 4 is a cross sectional view showing an example of a cable structure to which the invention is applicable.
Figure 5:
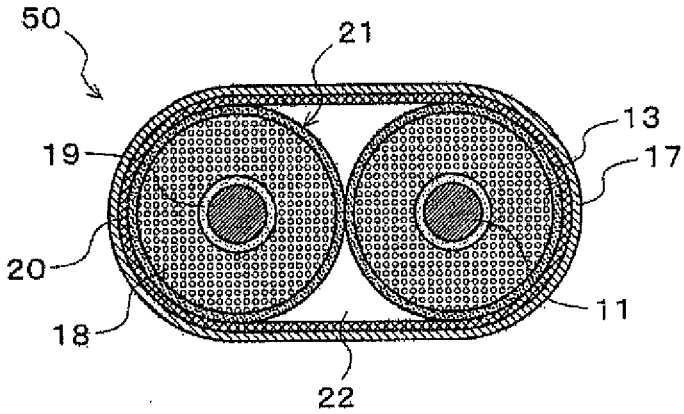
FIG. 5 is a cross sectional view showing an example of a cable structure to which the invention is applicable.
Figure 6:
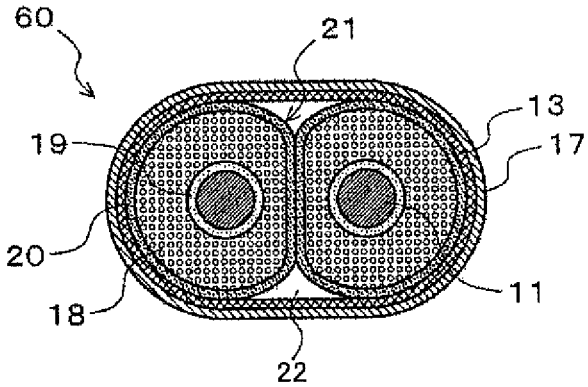
FIG. 6 is a cross sectional view showing an example of a cable structure to which the invention is applicable.

The invention is also applicable to any cable structures as long as a drain wire is not included, e.g., applicable to LAN cable, etc. Referring to FIGS. 4 to 6, the invention is applicable to, e.g., a cable structure 40 using a foamed insulation 18 instead of the insulation 12 (see FIG. 4), a cable structure 50 having two longitudinally arranged wires 21 each formed by covering the signal conductor 11 with an inner skin layer 19, the foamed insulation 18 and an outer skin layer 20 (see FIG. 5) and a cable structure 60 in which the two longitudinally arranged wires 21 are fused and bonded together (see FIG. 6). Meanwhile, the cable structures 50 and 60 of FIGS. 5 and 6 have a gap 22 between the wires 21 and the shield conductor 13.

Next, a non-drain differential signal transmission cable in a second embodiment will be described.

Figure 7:
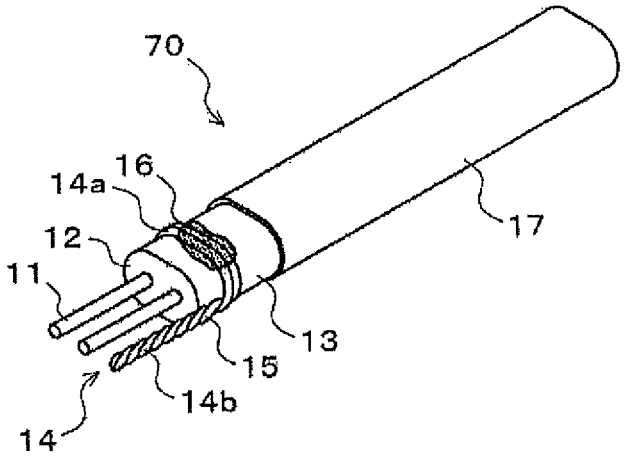
FIG. 7 is a perspective view showing a non-drain differential signal transmission cable in a second embodiment of the invention.

As shown in FIG. 7, a non-drain differential signal transmission cable 70 in the second embodiment is different from the non-drain differential signal transmission cable 10 in the first embodiment only in that the pin portion 14*b* is formed by twisting together the both end portions of the wire 15.

Figure 8:
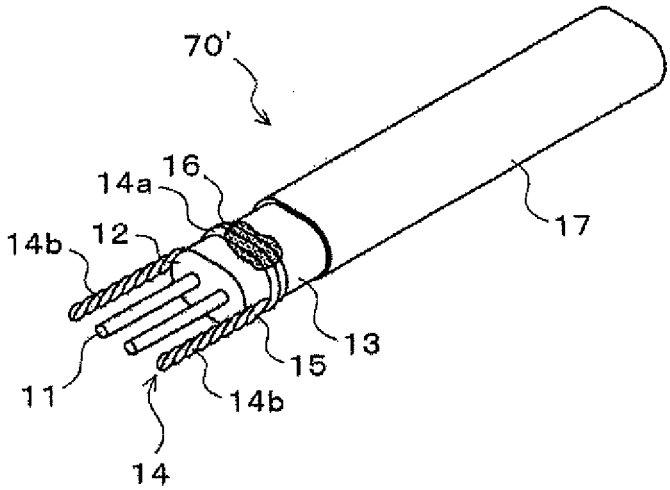
FIG. 8 is a perspective view showing a non-drain differential signal transmission cable in a modification of the second embodiment of the invention.

In addition, two pin portions 14*b* may be provided as is in a non-drain differential signal transmission cable 70' shown in FIG. 8 in the same manner as the non-drain differential signal transmission cable 10' in the modification of the first embodiment.

It should be noted that other structures are the same as those of the non-drain differential signal transmission cables 10 and 10' and the explanation thereof will be omitted.

Although it has been explained that the ground connecting pin 14 in the non-drain differential signal transmission cables 10, 10', 70 and 70' is formed by winding the wire 15 around the shield conductor 13 and then forming the end portion of the wound wire 15 into a pin shape, it is not limited thereto.

Figure 9:
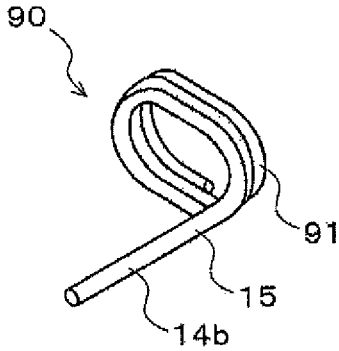
FIG. 9 is a perspective view showing a pin member.

For example, to form the ground connecting pin 14, a pre-made pin member 90 provided with a spiral portion 91 formed by shaping a portion of the wire 15 into a spiral shape and the pin portion 14*b* formed by shaping the end portion of the wire 15 into a pin shape as shown in FIG. 9 may be attached around the shield conductor 13 using the spiral portion 91 of the pin member 90 as the winding portion 14*a*.

At this time, the spiral portion 91 is formed to have an inner diameter which is about several μm larger than the outer diameter of the shield conductor 13 so as to facilitate attachment to the shield conductor 13.

When attaching the pin member 90 to the shield conductor 13, the spiral portion 91 is attached around the shield conductor 13 by soldered connection.

Although the pin member 90 to be the ground connecting pin 14 of the non-drain differential signal transmission cable 10 in the first embodiment is illustrated as an example in FIG. 9, it is possible to use a pin member in the non-drain differential signal transmission cables 10', 70 and 70' in the same manner.

Next, a ground connection structure of a non-drain differential signal transmission cable in the present embodiment will be described. An example using the non-drain differential signal transmission cable 70 will be described here.

Figure 10:
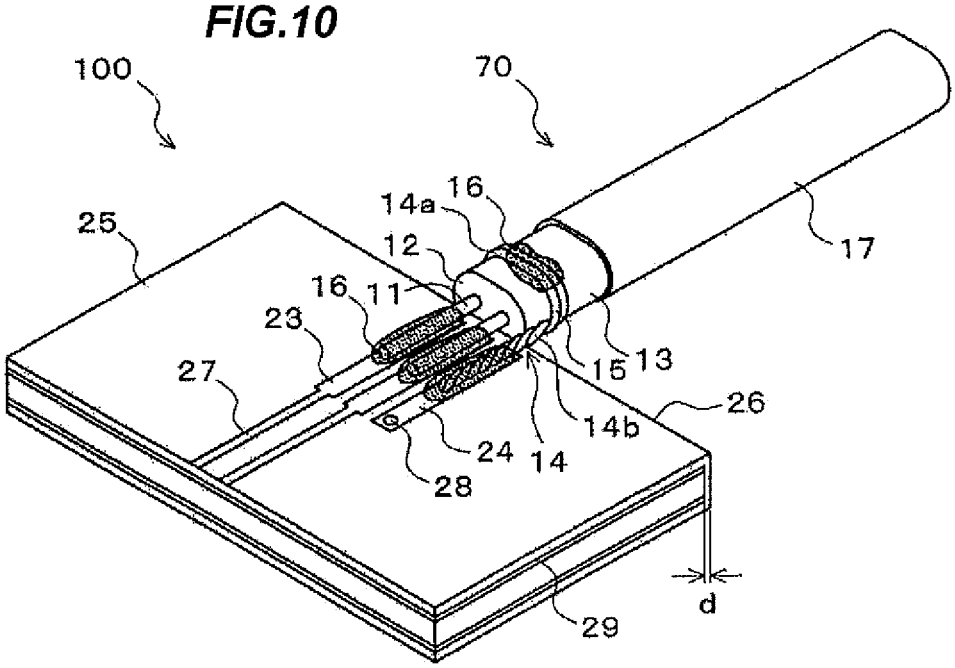
FIG. 10 is a perspective view showing a ground connection structure of a non-drain differential signal transmission cable in an embodiment of the invention.

As shown in FIG. 10, a ground connection structure of a non-drain differential signal transmission cable (hereinafter, simply referred to as "ground connection structure") 100 in the present embodiment is provided with the non-drain differential signal transmission cable 70 and a substrate 25 on which signal line pads 23 for connecting the pair of signal conductors 11 and a ground pad 24 for connecting the shield conductor 13 are formed, and the ground connection structure 100 is characterized in that the pair of exposed signal conductors 11 is soldered to the signal line pads 23 using a solder 16 and also the shield conductor 13 is soldered to the ground pad 24 via the pin portion 14*b* using the solder 16.

The signal line pads 23 are formed at an edge of the substrate 25 so as to be perpendicular to a side 26 of the edge at an interval equal to that of the signal conductors 11. Accordingly, it is possible to respectively solder the signal conductors 11 to the signal line pads 23 in a state that a distance therebetween is kept constant, and impedance mismatch at a cable connecting portion is thus less likely to occur.

In addition, the signal line pads 23 are connected to signal lines 27 formed on the substrate 25 and signals are transmitted through the signal lines 27.

The ground pad 24 is formed on one side of the signal line pad 23 so as to be parallel thereto. This is to align with the pin portion 14*b* which is provided in parallel to the signal conductors 11. As a result, the distance between the signal conductors 11 and the pin portion 14*b* can be kept constant and it is thus possible to reduce impedance mismatch at the cable connecting portion.

In addition, the ground pad 24 is connected to an inner ground layer 29 in the substrate 25 via a through-hole 28. Alternatively, the ground layer may be formed as a surface layer. A technique such as coplanar wiring is used when formed as a surface layer.

The signal line pads 23, the ground pad 24 and the inner ground layer 29 are formed at a distance d from the edge of the substrate 25. As a result, it is possible to prevent the shield conductor 13 of the non-drain differential signal transmission cable 70 from contacting with the signal line pads 23, the ground pad 24 and the inner ground layer 29 when the non-drain differential signal transmission cable 70 is connected to the substrate 25. Contact of the shield conductor 13 with the ground pad 24 or the inner ground layer 29 does not cause a problem of signal transmission even though there is a problem of impedance mismatch. However, when the shield conductor 13 contacts with the signal line pads 23, a short circuit occurs and signals cannot be transmitted. The structure described above is to avoid such a problem.

The signal line pads 23, the signal lines 27, the ground pad 24 and a non-illustrated circuit pattern are simultaneously formed on the substrate 25.

The non-drain differential signal transmission cable 70 is arranged at the edge of the substrate 25 so that only the pair of signal conductors 11 and the pin portion 14*b* are located on the substrate 25. The reason is as follows.

Figure 16:
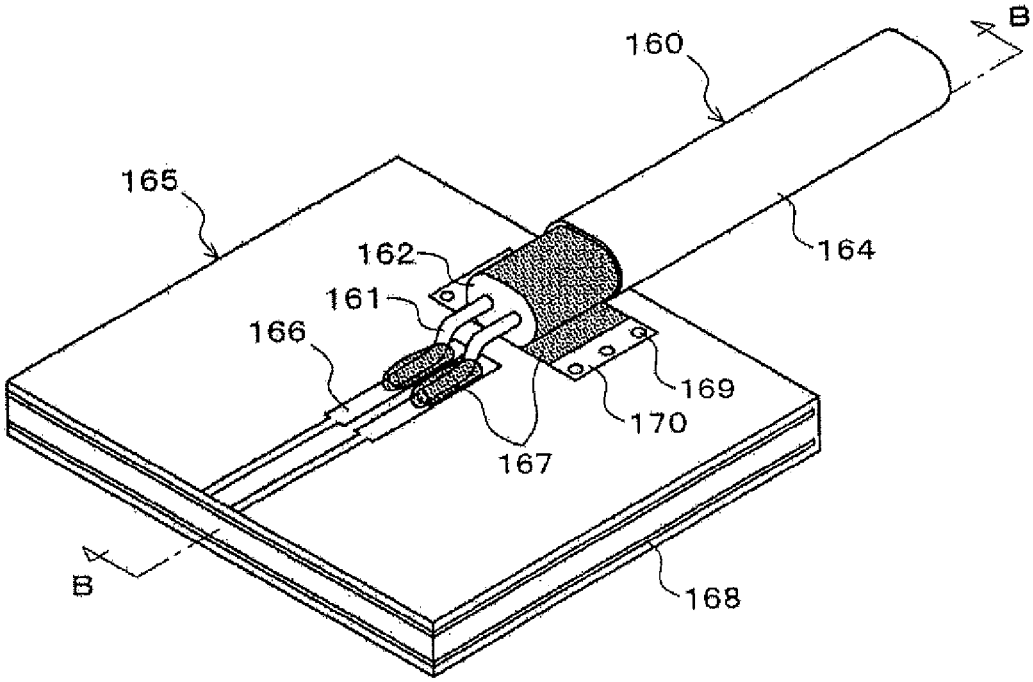
FIG. 16 is a perspective view showing a ground connection structure of a non-drain differential signal transmission cable in a conventional art.
Figure 17:
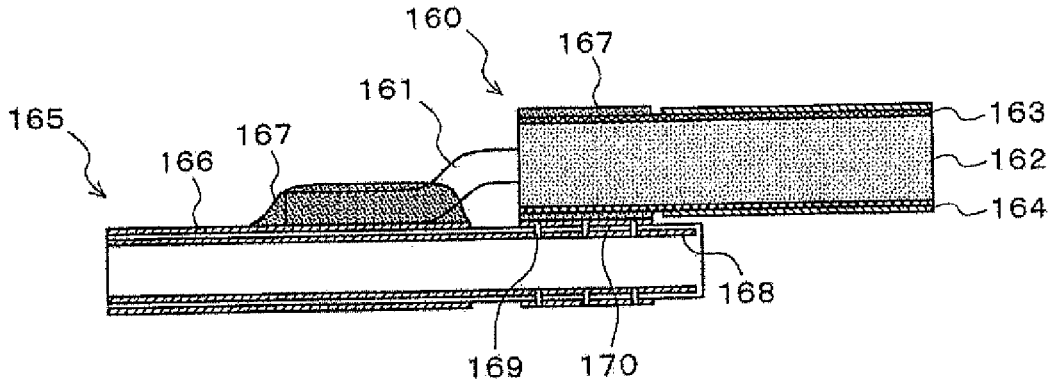
FIG. 17 is a cross sectional view taken on line B-B, showing the ground connection structure of a non-drain differential signal transmission cable shown in FIG. 16.

Conventionally, a terminal portion of the differential signal transmission cable 160 is placed on the substrate 165 such that the shield conductor 163 is connected to the ground pad 170 and, in this state, the signal conductors 161 are soldered to the signal line pads 166. Therefore, the signal conductors 161 need to be bent by a size equivalent to about half of the height of the insulation 162 so that the signal conductors 161 come into contact with the signal line pads 166 (see FIGS. 16 and 17). At this time, the insulation 162 may be deformed by an external force acting thereon, which causes impedance mismatch at the cable connecting portion and deterioration of electrical characteristics of the differential signal transmission cable 160.

On the other hand, due to the arrangement in which only the pair of signal conductors 11 and the pin portion 14*b* are located on the substrate 25, the pair of signal conductors 11 and the pin portion 14*b* can be soldered to the signal line pads 23 and the ground pad 24 without being bent. As a result, impedance mismatch caused by deformation of the insulation 12 can be prevented and it is also possible to prevent deterioration in electrical characteristics of the non-drain differential signal transmission cable 70. Furthermore, the height of the ground connection structure 100 per se can be reduced by the size equivalent to about half of the height of the insulation 12 and it is thus possible to downsize the ground connection structure 100.

Figure 11:
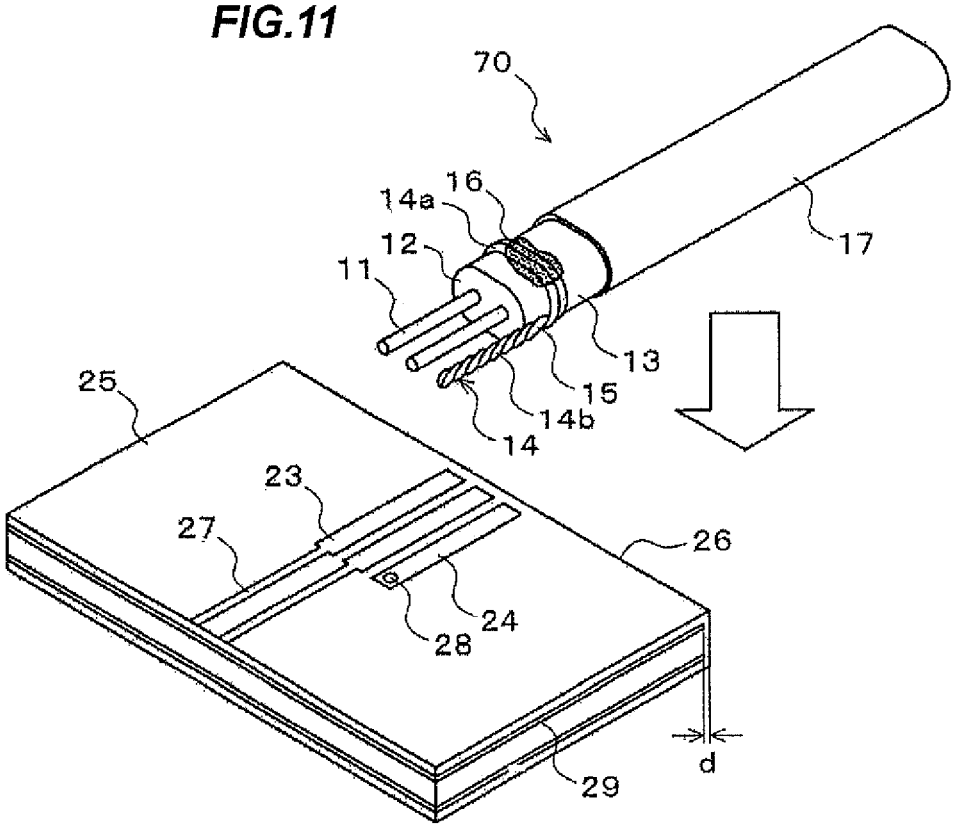
FIG. 11 is an explanatory diagram illustrating a procedure in which the non-drain differential signal transmission cable shown in FIG. 7 is connected to a substrate to make a ground connection structure of a non-drain differential signal transmission cable.

As shown in FIG. 11, it is possible to make the ground connection structure 100 by connecting the non-drain differential signal transmission cable 70 to the substrate 25. In detail, the pair of signal conductors 11 are placed on the signal line pads 23 and, at the same time, the pin portion 14*b* is placed on the ground pad 24, and then, solder connection is performed using the solder 16. At this time, the pair of signal conductors 11 and the pin portion 14*b* are soldered in a state that a distance therebetween is kept constant without bending. As a result, the ground connection. structure 100 with reduced impedance mismatch at the cable connecting portion is obtained.

In the ground connection structure 100, since the shield conductor 13 and the ground pad 24 are connected via the pin portion 14*b*, the ground pad 24 only needs to have a width (or area) which allows solder connection of the pin portion 14*b*. In other words, the width (or area) of the ground pad 24 of the ground connection structure 100 can be smaller than the case of directly soldering the shield conductor 13. Therefore, in the ground connection structure 100, since a width (or area) on the substrate occupied by the ground pad 24 is smaller than a conventional art, it is possible to improve a package density of the non-drain differential signal transmission cable 70 compared to the conventional art.

Figure 12:
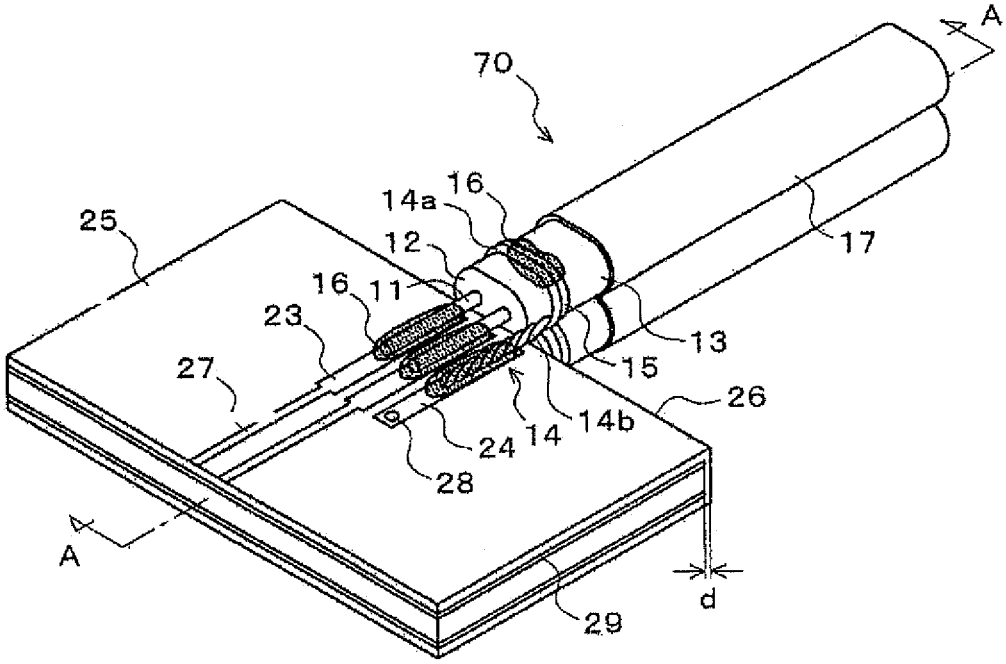
FIG. 12 is a perspective view showing a ground connection structure of a non-drain differential signal transmission cable in a modification of the invention.
Figure 13:
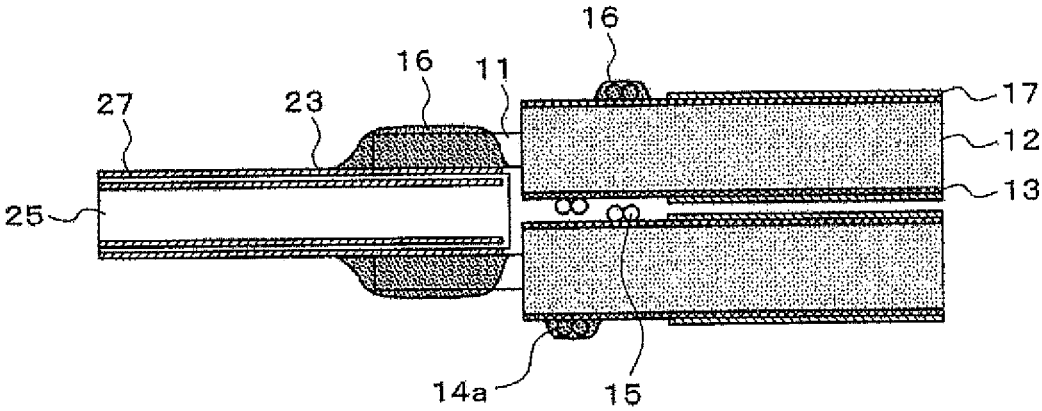
FIG. 13 is a cross sectional view taken on line A-A, showing the ground connection structure of a non-drain differential signal transmission cable shown in FIG. 12.

Alternatively, the signal line pads 23 and the ground pads 24 may be formed at the same positions on both sides of the substrate 25 as shown in FIG. 12 and FIG. 13 which is a cross sectional view taken on line A-A of FIG. 12, and in this case, the non-drain differential signal transmission cables 70 are attached to the same positions on the both sides of the substrate 25. In other words, the non-drain differential signal transmission cables 70 are longitudinally placed in a state that the pin portions 14*b* thereof are placed in reversed positions to each other, and each non-drain differential signal transmission cable 70 is attached by respectively connecting the pair of signal conductors 11 and the pin portion 14*b* thereof to the signal line pads 23 and the ground pad 24 which are formed on the connecting surface. As a result, it is possible to further improve the package density of the non-drain differential signal transmission cable 70 on one substrate 25.

Figure 14:
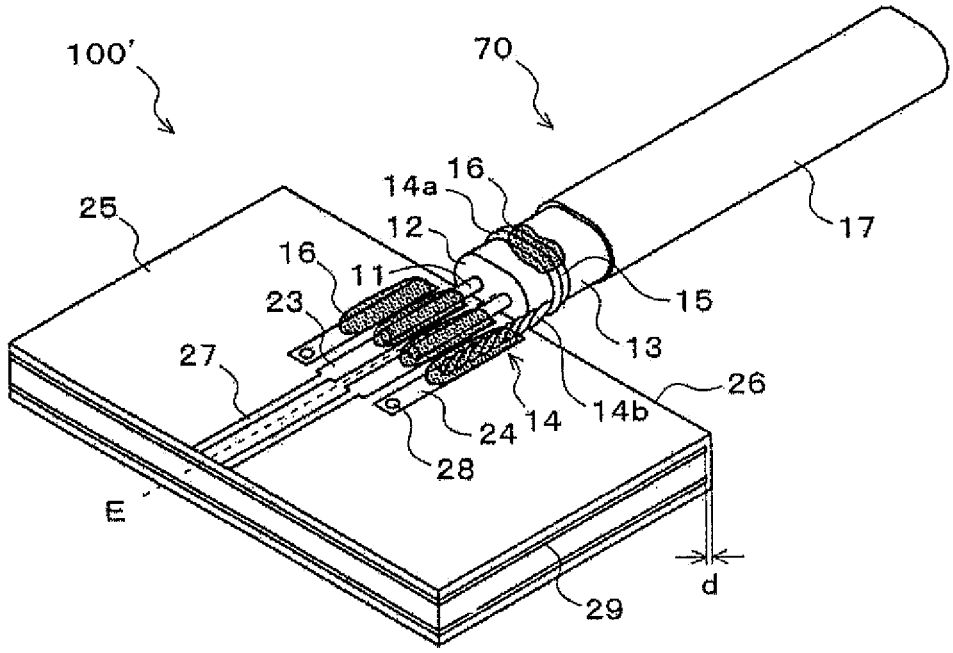
FIG. 14 is a perspective view showing a ground connection structure of a non-drain differential signal transmission cable in a modification of the invention.

Alternatively, the ground pads 24 may be formed symmetrically with respect to a longitudinal extension line E of the non-drain differential signal transmission cable 70 so as to sandwich two signal line pad 23 from both sides, as is in a ground connection structure 100' shown in FIG. 14. In this case, one of the ground pads 24 is a dummy ground pad to which the pin portion 14*b* is not soldered. This allows electric field distribution for the pair of signal conductors 11 around the cable connecting portion to be further balanced, and it is possible to further ensure impedance match at the cable connecting portion.

Figure 15:
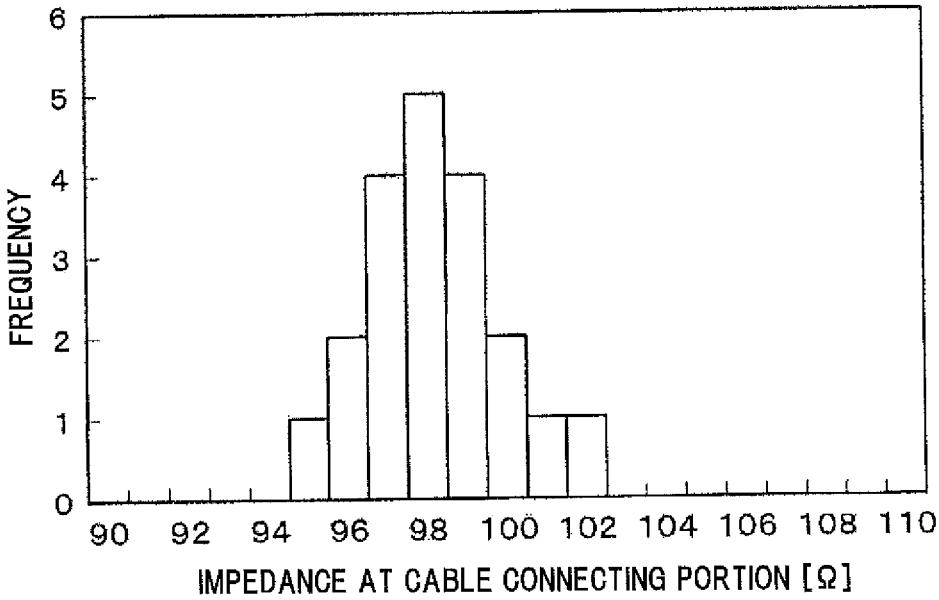
FIG. 15 is a frequency distribution graph showing an evaluation result of impedance distribution at a cable connecting portion of the ground connection structure of a non-drain differential signal transmission cable in FIG. 14.

When a sample is actually made based on the ground connection structure 100' shown in FIG. 14 and impedance distribution at a cable connecting portion is evaluated, frequency distribution graph as show in FIG. 15 is obtained.

According to the result, impedance at the cable connecting portion in the ground connection structure 100' is 95 to 102Ω and it is understood that characteristics sufficient for a system with impedance of 100Ω is obtained. A strict technical specification of about 100±5Ω is required especially for high-speed application, and the ground connection structure 100' meets this requirement.

As described above, according to the invention, it is possible to prevent thermal load from being applied to the shield conductor/the insulation during soldering work, i.e., to prevent melting or evaporation of the shield conductor and deformation or melting of the insulation during the soldering work, and also possible to improve a package density.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A non-drain differential signal transmission cable, comprising:

a pair of signal conductors aligned in parallel;

an insulation around the pair of signal conductors;

a shield conductor around the insulation; and a ground connecting pin to electrically connect the shield conductor to a ground, the ground connecting pin comprising a single wire, wherein an end portion of the pair of signal conductors is exposed with the insulation and the shield conductor removed, and wherein the ground connecting pin comprises a winding portion wound around the shield conductor to be electrically connected to the shield conductor, and a pin portion extending from the winding portion and having an elongate shape.

2. The non-drain differential signal transmission cable according to claim 1, wherein the pin portion is formed by twisting together both end portions of the wire.

3. The non-drain differential signal transmission cable according to claim 1, wherein the ground connecting pin comprises a pin member comprising a spiral portion formed by shaping a portion of the wire into a spiral shape and the pin portion formed by shaping the end portion of the wire into a pin shape, the pin member being preliminarily made, and wherein the spiral portion of the pin member is attached as the winding portion around the shield conductor to form the ground connecting pin.

4. The non-drain differential signal transmission cable according to claim 1, wherein the winding portion is formed by winding a portion of the wire twice or more around the shield conductor.

5. The non-drain differential signal transmission cable according to claim 1, wherein the winding portion is solder-connected to the shield conductor.

6. The non-drain differential signal transmission cable according to claim 1, wherein the wire comprises a copper wire and silver- or tin-plating applied to the copper wire.

7. The non-drain differential signal transmission cable according to claim 1, wherein the pin portion is disposed parallel to the pair of signal conductors.

8. The non-drain differential signal transmission cable according to claim 1, wherein the pin portion is disposed so as to cross a center line that passes through a center of the pair of signal conductors.

9. The non-drain differential signal transmission cable according to claim 1, wherein two of the pin portion are provided.

10. The non-drain differential signal transmission cable according to claim 9, wherein the two of the pin portion are provided line-symmetrically with respect to a line orthogonally passing a center of a line segment connecting centers of the pair of signal conductors.

11. A ground connection structure of a non-drain differential signal transmission cable, comprising:

the non-drain differential signal transmission cable according to claim 1; and a substrate on which a signal line pad for connecting the pair of signal conductors and a ground pad for connecting the shield conductor are formed, wherein the pair of exposed signal conductors is solder-connected to the signal line pad and the shield conductor is electrically connected to the ground pad via the pin portion.

12. The ground connection structure according to claim 11, wherein the signal line pad is formed at an edge of the substrate so as to be orthogonal to one side of the edge at an interval equal to that of the signal conductors.

13. The ground connection structure according to claim 11, wherein the ground pad is formed parallel to the signal line pad.

14. The ground connection structure according to claim 11, wherein the signal line pad and the ground pad are formed at a distance from the edge of the substrate.

15. The ground connection structure according to claim 11, wherein the non-drain differential signal transmission cable is arranged at the edge of the substrate so that only the pair of signal conductors and the pin portion are located on the substrate.

16. The ground connection structure according to claim 11, wherein the signal line pad and the ground pad are formed on both sides of the substrate, and the non-drain differential signal transmission cables are attached to the both sides of the substrate.

17. The ground connection structure according to claim 11, wherein the ground pad is formed symmetrically on both sides of the signal line pads.

18. The non-drain differential signal transmission cable according to claim 1, wherein the ground connecting pin is spirally wound at a spiral portion of the single wire.

19. The non-drain differential signal transmission cable according to claim 18, wherein the pin portion is protruded from the spiral portion.

20. The non-drain differential signal transmission cable according to claim 1, wherein the single wire extends seamlessly through an entirety of the ground connecting pin.

* * * * *